US009517642B2

(12) United States Patent
Nieda et al.

(10) Patent No.: US 9,517,642 B2
(45) Date of Patent: Dec. 13, 2016

(54) PRINTING APPARATUS

(75) Inventors: Kengo Nieda, Kawasaki (JP); Masato Izumi, Kawasaki (JP); Masashi Kurihara, Hiratsuka (JP); Hiroyuki Kakishima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 13/613,727

(22) Filed: Sep. 13, 2012

(65) Prior Publication Data

US 2013/0100222 A1 Apr. 25, 2013

(30) Foreign Application Priority Data

Oct. 21, 2011 (JP) ..... 2011-231518

(51) Int. Cl.

| | |
|---|---|
| ***B41J 3/60*** | (2006.01) |
| ***B41J 11/00*** | (2006.01) |
| ***B41J 11/66*** | (2006.01) |
| ***B41J 11/70*** | (2006.01) |
| ***B41J 15/04*** | (2006.01) |

(52) U.S. Cl.

CPC ..... *B41J 3/60* (2013.01); *B41J 11/008* (2013.01); *B41J 11/0075* (2013.01); *B41J 11/663* (2013.01); *B41J 11/70* (2013.01); *B41J 15/04* (2013.01)

(58) Field of Classification Search

CPC ..... B41J 11/66; B41J 11/663; B41J 11/666; B41J 11/70; B41J 11/706; B41J 13/106

USPC ..... 347/19, 101, 104

See application file for complete search history.

(56) References Cited

U.S. PATENT DOCUMENTS

| | | | | |
|---|---|---|---|---|
| 5,700,006 | A | 12/1997 | Sekiya et al. | |
| 5,765,826 | A | 6/1998 | Isoda et al. | |
| 6,091,928 | A * | 7/2000 | Fuchisawa | B41J 11/006 399/384 |
| 6,527,267 | B1 | 3/2003 | Kuwata et al. | |

(Continued)

FOREIGN PATENT DOCUMENTS

| | | | |
|---|---|---|---|
| CN | 1190226 | A | 8/1998 |
| CN | 102015317 | A | 4/2011 |

(Continued)

OTHER PUBLICATIONS

Chinese Office Action issued in Chinese Application No. 201210400880.2 dated Jun. 5, 2014.

(Continued)

*Primary Examiner* — Matthew Luu
*Assistant Examiner* — Patrick King
(74) *Attorney, Agent, or Firm* — Fitzpatrick, Cella, Harper & Scinto

(57) ABSTRACT

A decision is made for each page as to whether to allow image printing on that page, by comparing the remaining sheet length DL with a length of an image about to be printed, IL. A length of a non-printed, rear-end cut sheet is also checked to determine whether the non-printed cut sheet needs to be further cut into smaller sheets. This arrangement can prevent a complete image to be printed in one page from being broken and only partly printed in the last portion of a paper roll, ensure that printed cut sheets and non-printed cut sheets are stably conveyed and discharged and enable the non-printed cut sheets to be almost equal in size so that they can be properly accommodated in the associated tray.

5 Claims, 8 Drawing Sheets

(56) References Cited

U.S. PATENT DOCUMENTS

| | | | | |
|---|---|---|---|---|
| 6,643,480 | B2 | 11/2003 | Kuwata et al. | |
| 6,830,245 | B2 | 12/2004 | Matsushima et al. | |
| 6,871,848 | B2 | 3/2005 | Matsushima et al. | |
| 6,877,742 | B2 | 4/2005 | Nishikata et al. | |
| 7,029,006 | B2 | 4/2006 | Izumi et al. | |
| 7,032,900 | B2 | 4/2006 | Nishikata et al. | |
| 7,360,887 | B2 * | 4/2008 | Konno | 347/103 |
| 7,441,887 | B2 * | 10/2008 | Senga | B41J 11/008 347/107 |
| 7,483,661 | B2 * | 1/2009 | Kishi | 399/302 |
| 8,641,305 | B2 * | 2/2014 | Yasuzaki | B41J 3/60 347/104 |
| 2004/0036755 | A1 | 2/2004 | Guillen et al. | |
| 2005/0141009 | A1 * | 6/2005 | Kiwada | 358/1.14 |
| 2005/0212889 | A1 * | 9/2005 | Kitamura et al. | 347/171 |
| 2005/0212890 | A1 * | 9/2005 | Kitamura et al. | 347/171 |
| 2008/0030536 | A1 * | 2/2008 | Furukawa et al. | 347/16 |
| 2009/0236385 | A1 | 9/2009 | Itoh | |
| 2010/0330262 | A1 * | 12/2010 | Takeuchi | B41J 11/008 427/8 |
| 2011/0211008 | A1 * | 9/2011 | Teshigawara et al. | 347/16 |
| 2011/0211009 | A1 * | 9/2011 | Fujinaga | B41J 29/393 347/16 |
| 2011/0239839 | A1 | 10/2011 | Yoshida et al. | |
| 2013/0044151 | A1 * | 2/2013 | Masuda | B41J 13/0009 347/16 |
| 2014/0119751 | A1 * | 5/2014 | Yasuzaki | G06F 3/1296 399/38 |

FOREIGN PATENT DOCUMENTS

| | | | |
|---|---|---|---|
| JP | 07-291500 | A | 11/1995 |
| JP | 8-174932 | A | 7/1996 |
| JP | 2001-171881 | | 6/2001 |
| JP | 4154586 | B2 | 9/2008 |
| JP | 2011-090651 | A | 5/2011 |
| JP | 2011-177905 | A | 9/2011 |

OTHER PUBLICATIONS

Japanese Office Action issued in counterpart Japanese Patent Application No. 2011-231518, dated Dec. 15, 2015.

* cited by examiner

PRINTING APPARATUS

BACKGROUND OF THE INVENTION

Field of the Invention

The present invention relates to a method of handling an end portion of a continuous sheet, rolled in the form of a paper roll, when a printing operation is performed on the continuous sheet.

Description of the Related Art

In a printing apparatus that prints on roll paper, a continuous sheet of the roll is unwound from an outermost periphery and moved under a print head for image printing. This type of printing apparatus cuts the continuous sheet according to the size of a printed image and discharges the printed cut sheet onto a tray. A tail end portion of the paper roll often requires special processing for the following reasons. First, it is necessary to prevent one complete image from being broken halfway by the tail end of the roll. Second, even if the image has been printed completely to the end, too short a distance from the cutting position to the tail end of the roll can result in the remaining unprinted sheet failing to be conveyed in the printing apparatus in either direction, forward or backward. To minimize a wasteful use of the roll paper while at the same time keeping the last non-printed cut sheet large enough to be able to be conveyed in the printing apparatus, it is therefore required to detect and manage the tail end of the roll correctly for its smooth conveyance.

Japanese Patent Laid-Open No. 2001-171881, for example, discloses a construction in which a unit is provided to measure the diameter of a paper roll to manage the distance that a continuous sheet of the roll is fed from when the roll diameter has reduced to a threshold value. More precisely, this method involves presetting as a maximum available length the distance that the continuous sheet of the roll can be fed from when the roll diameter has reduced to the threshold value and stopping printing when the distance that the continuous sheet has been fed after the roll diameter decreased to the threshold value has reached the preset maximum available length. With the technique of Japanese Patent Laid-Open No. 2001-171881, it is possible to avoid a remaining unprinted sheet, which has been cut and separated from the printed sheet, becoming unable to be conveyed, while at the same time minimizing a wasteful use of the paper roll.

In Japanese Patent Laid-Open No. 2001-171881, however, a comparison is made between the maximum available length and the distance the continuous sheet has been fed (accumulated length) each time one line is printed. When the accumulated feeding length has reached the maximum available length, the printing of the next line is stopped. So, when an image extending over a plurality of lines is printed, there is a possibility of this image being broken partway near the tail end of the roll. Furthermore, Japanese Patent Laid-Open No. 2001-171881 does not give a detailed description of how, after the printing operation has been stopped, the printed sheet and the unprinted sheet separated by cutting are discharged. Since the printed and unprinted sheets are discharged en masse, the user is left with the task of sorting them out.

SUMMARY OF THE INVENTION

The present invention has been accomplished to solve the aforementioned problems. It is therefore an object of this invention to provide a printing apparatus that can form a complete one-page image in the last printed sheet of the roll and correctly discharge the printed and unprinted cut sheets.

In a first aspect of the present invention, there is provided a printing apparatus comprising: a conveyance unit configured to convey a continuous sheet and cut sheets; an image length acquisition unit configured to acquire a length in a direction of conveyance of an image to be printed; a printing unit configured to print images on the continuous sheet as it is conveyed by the conveyance unit; a cutting unit installed downstream of the printing unit in the direction of conveyance and configured to cut the continuous sheet into a plurality of cut sheets according to the image length acquired by the image length acquisition unit; a discharging unit configured to discharge the cut sheets; a remaining sheet length management unit configured to manage a remaining length of the continuous sheet that changes as the continuous sheet is conveyed; and a decision-making unit configured to decide whether or not to allow the printing unit to print images, by comparing the remaining sheet length managed by the remaining sheet length management unit with the image length acquired by the image length acquisition unit.

In a second aspect of the present invention, there is provided a printing apparatus to print images on front and back sides of a continuous sheet, the printing apparatus comprising: a conveyance unit configured to convey a continuous sheet and cut sheets; an image length acquisition unit configured to acquire lengths in a direction of conveyance of a plurality of images to be printed on the front side of the continuous sheet; a printing unit configured to print images on the front or back side of the continuous sheet as it is conveyed by the conveyance unit; a remaining sheet length management unit configured to manage a remaining length of the continuous sheet that changes as the continuous sheet is conveyed; a decision-making unit configured to decide, for each of the plurality of images, whether or not to allow the printing unit to print the image on the front side of the continuous sheet, by comparing the remaining sheet length managed by the remaining sheet length management unit with the length of each of the plurality of images acquired by the image length acquisition unit; a cutting unit installed downstream of the printing unit in the direction of conveyance and configured to cut the continuous sheet at a rear end of the last of the images printed on the continuous sheet by the printing unit; and a conveyance direction switching unit configured to invert the front and back sides of a sheet already printed on the front side and cut by the cutting unit and carry it to a position of the printing unit, the conveyance direction switching unit also being configured to discharge a cut sheet not printed on the front side.

In a third aspect of the present invention, there is provided a printing apparatus comprising: a conveyance unit configured to convey a continuous sheet and cut sheets; a printing unit configured to print an image on the continuous sheet conveyed by the conveyance unit; a cutter configured to cut the continuous sheet for every page; and a remaining sheet length management unit configured to manage a length of the continuous sheet remaining to be printed; wherein, if the remaining sheet length managed by the remaining sheet length management unit is smaller than a sum of a length of a next page to be printed and a minimum sheet length required for a cut sheet to be able to be conveyed by the conveyance unit, the next page is not printed.

In a fourth aspect of the present invention, there is provided a printing apparatus comprising: a conveyance unit configured to convey a continuous sheet and cut sheets; a printing unit configured to print an image on the continuous sheet conveyed by the conveyance unit; a cutter configured to cut the continuous sheet for every page; and a remaining sheet length management unit configured to manage a length of the continuous sheet remaining to be printed; wherein, if the remaining sheet length managed by the remaining sheet length management unit is smaller than a sum of a length of a next page to be printed, a length of a regulating image to be printed upstream of the next page and a minimum sheet length required for a cut sheet to be able to be conveyed by the conveyance unit, the next page is not printed.

In a fifth aspect of the present invention, there is provided a printing apparatus to print images on front and back sides of a continuous sheet, the printing apparatus comprising: a conveyance unit configured to convey a continuous sheet and cut sheets; a printing unit configured to print an image on the continuous sheet conveyed by the conveyance unit; a cutter configured to cut the continuous sheet for every page; and a remaining sheet length management unit configured to manage a length of the continuous sheet remaining to be printed; wherein, if the remaining sheet length managed by the remaining sheet length management unit is smaller than a sum of a length of a next page to be printed and a minimum sheet length required for a cut sheet to be able to be conveyed by the conveyance unit, or if the remaining sheet length is smaller than a sum of a length of a page to be printed on the back side of the next page, a length of a regulating image to be printed prior to the printing of the back side page and the minimum sheet length required for a cut sheet to be able to be conveyed by the conveyance unit, the next page is not printed.

Further features of the present invention will become apparent from the following description of exemplary embodiments (with reference to the attached drawings).

DESCRIPTION OF THE EMBODIMENTS

This embodiment will be described by taking up an inkjet printing apparatus as an example. The inkjet printing apparatus of this embodiment is a high-speed line-type printer that can perform both a one-side print mode and a two-side print mode on a continuous sheet in the form of a paper roll.

Figure 1:
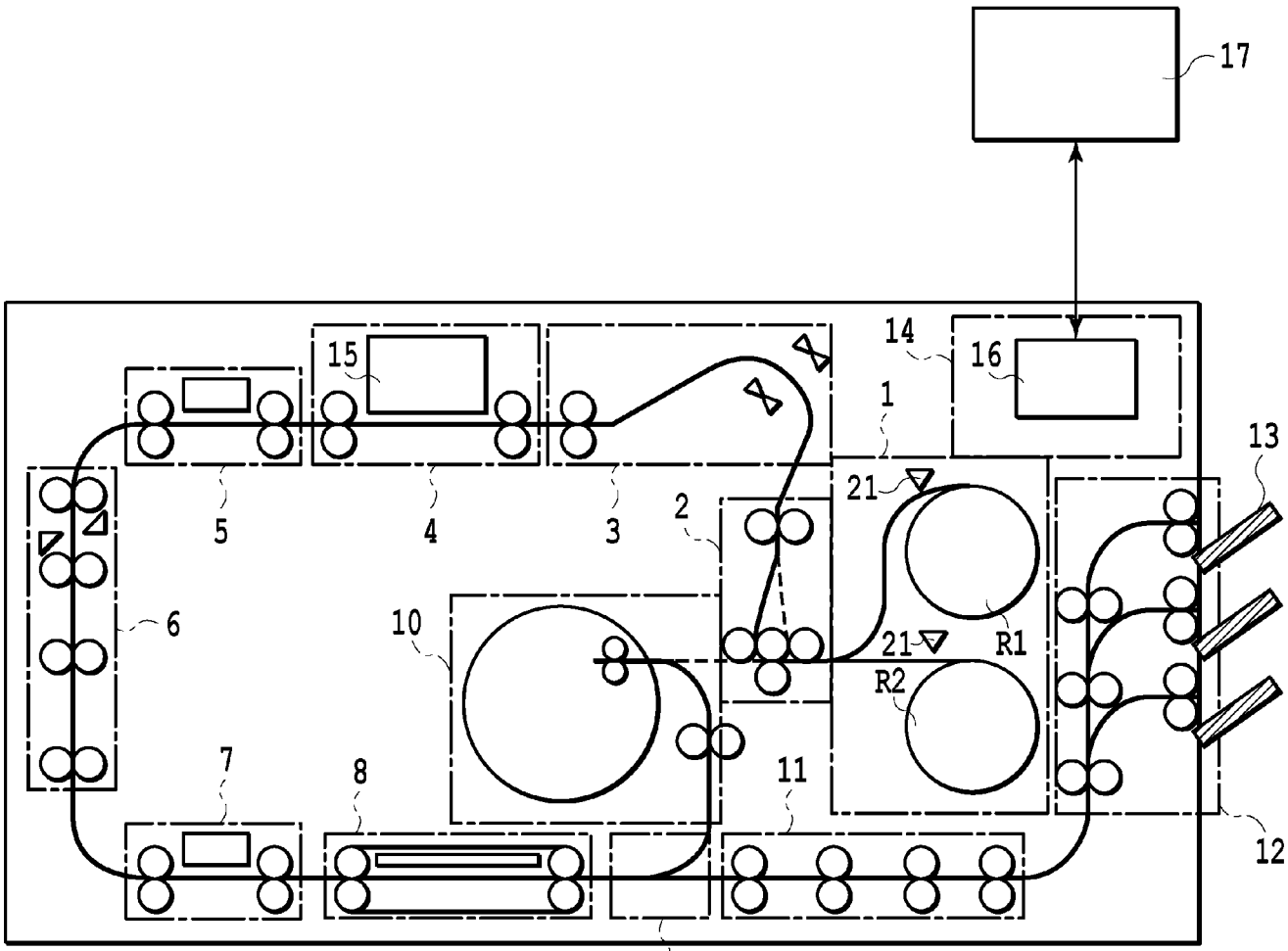
FIG. 1 is a schematic view showing an internal construction of a printing apparatus to which this invention can be applied.

FIG. 1 shows an internal construction of a printing apparatus that can apply the present invention. Installed in the printing apparatus are a sheet feeding unit 1, a decurling unit 2, a slant conveying correction unit 3, a printing unit 4, an inspection unit 5, a cutting unit 6, a information recording 7, a drying unit 8, a path switching unit 9, a sheet winding unit 10, a discharging/conveying unit 11, a sorting unit 12, discharge trays 13 and a control unit 14. The sheet is transported by a conveying mechanism, made up of a roller and a belt, along a sheet conveying path shown in a solid line in the figure to the respective units where it undergoes the associated processing.

The sheet feeding unit 1 accommodates a continuous rolled sheet and supplies it to successive units. The sheet feeding unit 1 has a capacity of accommodating two sheet rolls R1, R2 and draws out the sheet of a selected one of the two rolls. The sheet feeding unit 1 has a tail end sensor 21 for each of the rolls. It is noted here that the number of sheet rolls that can be accommodated in the sheet feeding unit 1 and the number of the tail end sensors are not limited to two but any other desired number of them may be used.

The decurling unit 2 alleviates a curl (or a coiled state) of the sheet fed from the sheet feeding unit 1. The decurling unit 2 uses one drive roller and two pinch rollers to give the sheet a reverse curl to reduce the original curl.

The slant conveying correction unit 3 corrects an inclination of the sheet after passing the decurling unit 2 (a sheet inclination with respect to a direction in which it is intended to be conveyed). It pushes a reference side edge of the sheet against a guide member so that the sheet is conveyed without any inclination from the intended direction.

The printing unit 4 with a print head 15 forms an image on the sheet as it is moved forward. The printing unit 4 also has a conveyance roller (conveyance member) that advances the sheet forward.

The print head 15 is of a line type that has a plurality of inkjet nozzle arrays formed therein, spanning a maximum printable width of the sheet. These nozzle arrays on the print head 15 are arranged parallel to each other in a sheet conveyance direction. In this example, the print head has seven nozzle arrays corresponding to seven colors: C (cyan), M (magenta), Y (yellow), LC (light cyan), LM (light magenta), G (gray) and K (black). The numbers of colors and of nozzle arrays may be other than seven. The print head may adopt any of currently available ink ejection methods that use as printing elements electrothermal conversion devices, piezoelectric devices, electrostatic devices or MEMS devices. Inks of seven colors are supplied to the print head 15 from associated ink tanks through ink tubes.

The inspection unit 5 optically reads a check pattern or image printed on the sheet by the printing unit 4 to check a state of nozzles of the print head 15, a sheet conveyance state and an image position.

The cutting unit 6 installed downstream of the print head 15 has a mechanical cutter to cut the printed sheet to a predetermined length. The cutting unit 6 also has a plurality of conveyance rollers to convey the sheet to the next process.

The information recording unit 7 records print information, such as serial number and date of the print, on the back of the sheet. The drying unit 8 heats the sheet printed with an image by the printing unit 4 to dry the ink applied to the sheet in a short time. The drying unit 8 also has a conveyance belt and rollers to convey the sheet to the next process.

The path switching unit 9, depending on whether to perform a one-side printing or two-side printing, changes the direction of sheet conveyance to send the sheet either to a sheet winding unit 10 or to a discharging/conveying unit 11.

The sheet winding unit 10, during the two-side printing, temporarily takes up the continuous sheet that has been printed on the surface side. The sheet winding unit 10 has a take-up drum on which to wind the sheet. In the two-side printing, the uncut continuous sheet that has been printed on the surface side is wound temporarily on the take-up drum. After the sheet is wound, the take-up drum is rotated in a reverse direction to feed the wound sheet to the decurling unit 2, from which it is further sent to the printing unit 4. By the time it reaches the printing unit 4, the sheet is already inverted upside down. So the printing unit 4 prints on the back side of the sheet. More detailed operation of the two-side printing will be described later.

The discharging/conveying unit 11 carries the sheet, that was cut by the cutting unit 6 and dried by the drying unit 8, to the sorting unit 12. The sorting unit 12 sorts the printed sheet into an associated group as required and discharges it into a corresponding discharge tray 13.

The control unit 14 controls the printing apparatus as a whole and has a CPU, a memory storing a control program, a controller 16, an interface, etc. The control unit 14 can communicate with an external device 17 through the interface.

Now, a basic operation during printing will be explained. The printing operation differs between the one-side print mode and the two-side print mode. Both operation modes will be described below.

Figure 2:
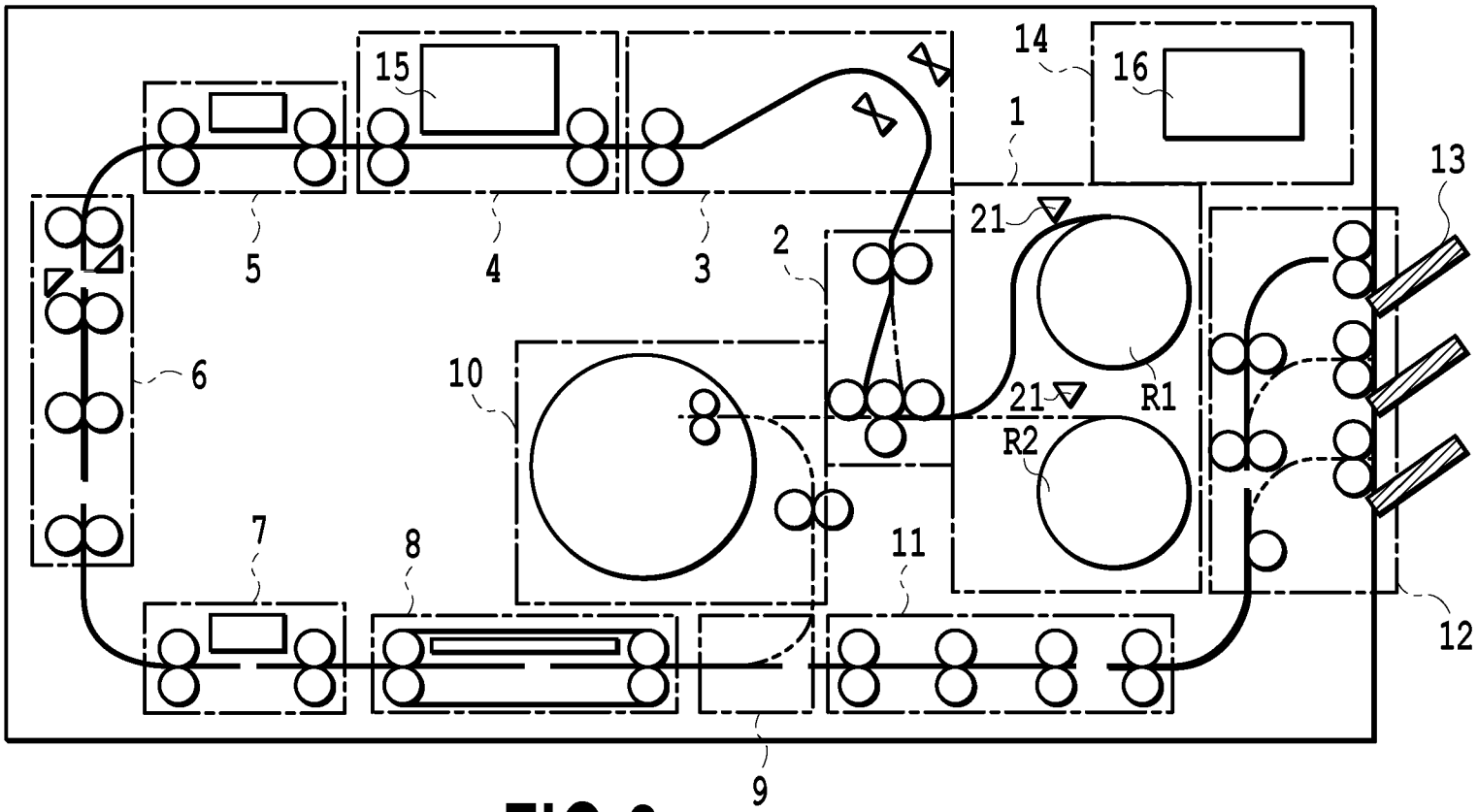
FIG. 2 shows an operation of the printing apparatus during a one-side print mode.

FIG. 2 shows how the one-side print mode that prints only on the front surface of the continuous sheet is performed. The path along which the sheet from the sheet feeding unit 1 is carried and printed before it is discharged to the discharge tray 13 is indicated by a thick solid line. The sheet fed from the sheet feeding unit 1 and processed by the decurling unit 2 and the slant conveying correction unit 3 is printed on its front surface by the printing unit 4. The printed sheet moves past the inspection unit 5 and then is cut to a predetermined page length by the cutting unit 6. The cut sheets are printed on their back with print information by the information recording unit 7 as required. The cut sheets are then conveyed one sheet at a time to the drying unit 8 where they are dried. Then, the dried sheets are discharged successively through the path switching unit 9 and the discharging/conveying unit 11 onto the trays 13 of the sorting unit 12.

Figure 3:
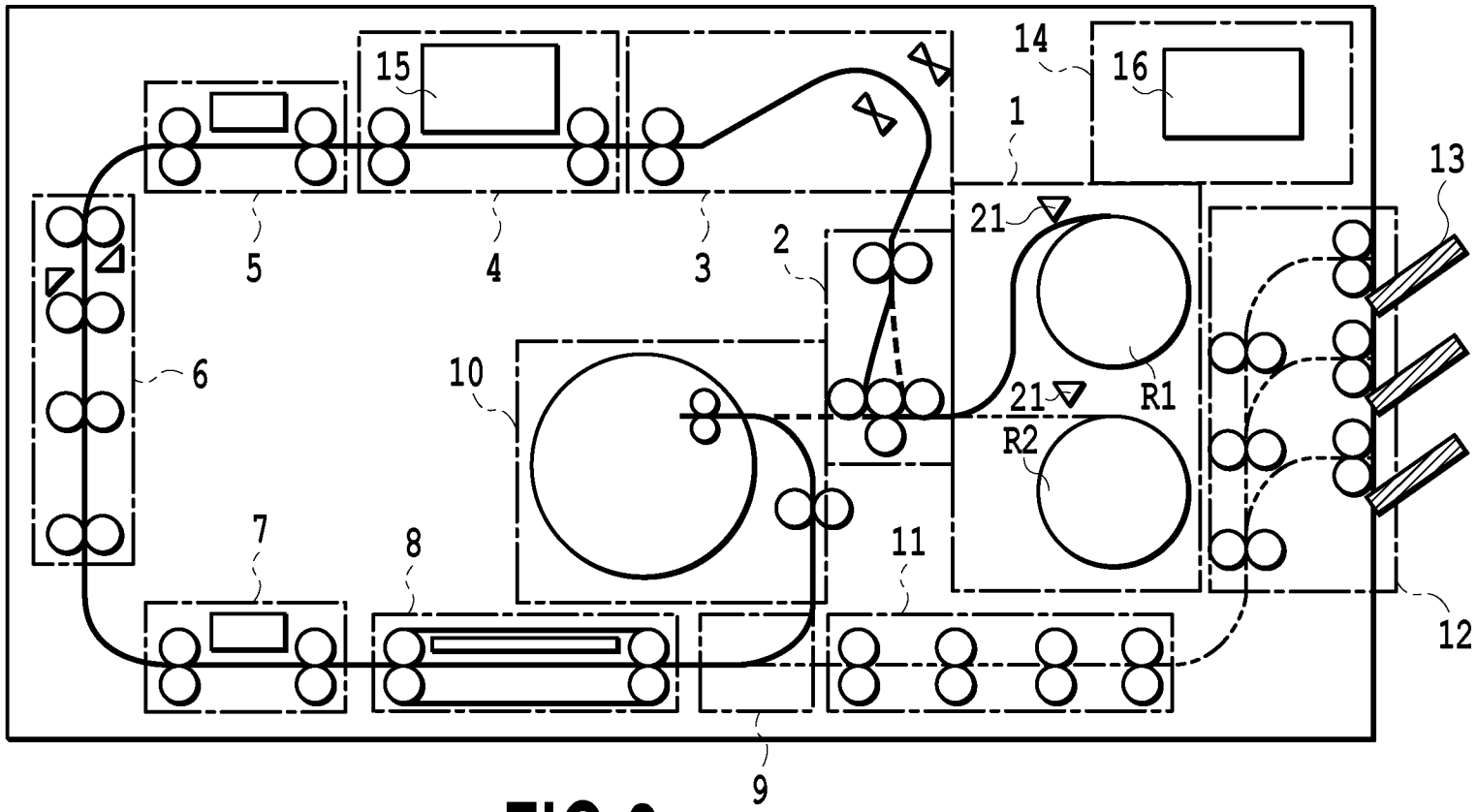
FIG. 3 shows an operation of the printing apparatus during a both-side print mode.

FIG. 3 shows the operation during the two-side print mode that prints on both front and back surfaces of a sheet. In the two-side printing operation, the front surface print sequence is followed by the back surface print sequence. In the first front surface print sequence, the printing apparatus operation from the sheet feeding unit 1 up to the inspection unit 5 is the same as the operation of the one-side print mode, except that the continuous sheet is not cut to the page length by the cutting unit 6 but is conveyed to the drying unit 8 in the continuous sheet state. After the ink on the surface is dried by the drying unit 8, the sheet is transferred by the path switching unit 9 onto the path toward the sheet winding unit 10, not to the path toward the discharging/conveying unit 11.

The sheet introduced to the sheet winding unit 10 is wound up on the take-up drum that rotates in a forward direction (counterclockwise in the figure). With the intended surface printing by the printing unit 4 complete, the rear end of a printed area of the continuous sheet is cut by the cutting unit 6. The long cut sheet continues to be carried through the drying unit 8 and the path switching unit 9 and wound onto the sheet winding unit 10 up to its rear end (cut position). The unprinted continuous sheet upstream of its front end (cut position), on the other hand, is pulled back toward the sheet feeding unit 1 so that its front end (cut position) does not remain at the decurling unit 2.

After the front surface print sequence described above is finished, the back surface print sequence is initiated. Now, the sheet winding unit 10 rotates in a reverse direction (clockwise in the figure) opposite the direction in which the take-up drum has wound up the sheet. The end of the wound sheet (the rear end of the wound sheet is unwound first to become a leading end of the sheet as it is fed from the sheet winding unit 10) is sent to the decurling unit 2, where the sheet is decurled in a direction opposite the direction in which it was previously decurled. This is because the sheet wound on the take-up drum is wound with its surface and back sides inverted and thus is imparted a reverse curl. Then, the sheet is forwarded through the slant conveying correction unit 3 to the printing unit 4 that prints on the back surface of the long cut sheet. The printed sheet is checked by the inspection unit 5 and cut to a predetermined unit length by the cutting unit 6. Since the cut sheets are already printed on both sides, they are not printed with any information by the information recording unit 7. The cut sheets are conveyed one sheet at a time to the drying unit 8, from which they are successively discharged through the path switching unit 9 and the discharging/conveying unit 11 to the trays 13 of the sorting unit 12.

As shown in FIGS. 1-3, the printing apparatus of this embodiment has many roller pairs for sheet conveyance. The continuous sheet and cut sheets are circulated through the printing apparatus as they are supported between and driven by the paired rolling rollers. In this embodiment, to ensure that the sheet is smoothly conveyed, the roll sheet tail end processing is performed so that the sheet being conveyed is longer than a maximum distance between two roller pairs installed next to each other.

Figure 4:
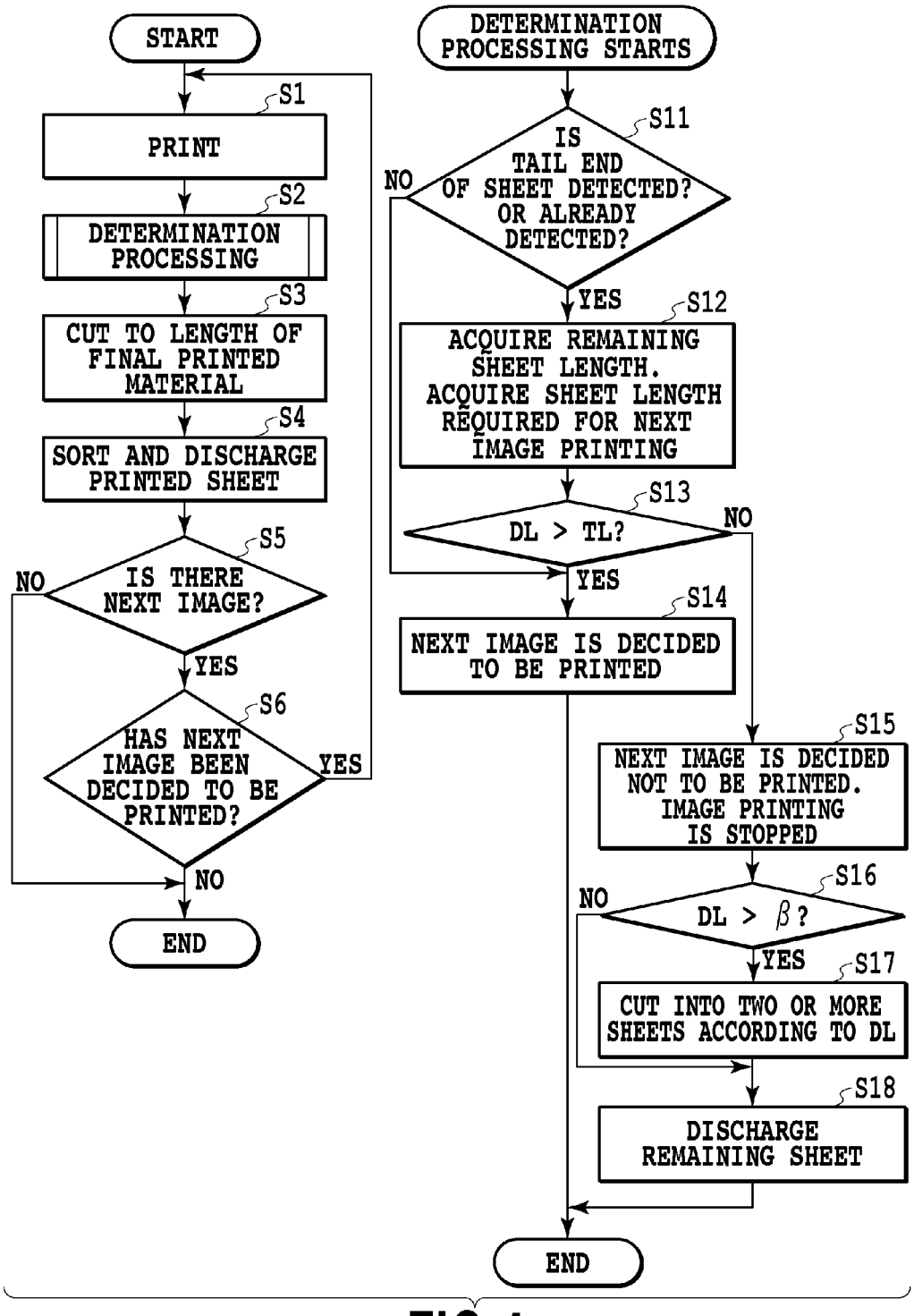
FIG. 4 is a flow chart showing a sequence of steps during the one-side print mode.

FIG. 4 is a flow chart showing a one-side print sequence performed by the controller 16 of this embodiment.

When a print command is received and the one-side print sequence is initiated, the controller 16 starts an image printing operation at step S1 in a main flow chart for printing, shown on the left side. At step S2, the controller 16 executes the determining processing while the printing operation continues. The determining processing will be described later.

After one page of image has been printed, the controller 16 at step S3 instructs the cutting unit 6 to cut the sheet at a position corresponding to an image length as measured from the front end of the sheet. Further at step S4, the controller 16 instructs the information recording unit 7, the drying unit 8, the path switching unit 9, the discharging/conveying unit 11 and the sorting unit 12 to discharge the cut sheet to the discharge tray 13.

At step S5 the controller 16 checks whether there is any image to be printed next. If it is decided that there is no image to be printed, this sequence is ended. If it is found that there is an image to be printed next, the processing moves to step S6. If step S6 finds that step S2 has determined the next image to be printed, the processing returns to step S1. If the determination made is not to print the next image, this processing is exited.

Shown on the right side of the figure is a flow chart of the determining processing executed by step S2. In the determining processing, step S11 checks whether a tail end of the continuous sheet roll is or has already been detected by the tail end sensor 21. During the one-side print sequence, the controller 16 is monitoring in real time the passage of the tail end of the roll by using the tail end sensor 21.

When the tail end of the sheet roll is detected or has already been detected, the processing moves to step S12. If the tail end is not detected, the processing jumps to step S14.

Step S12 updates a remaining amount of sheet, DL. The remaining sheet length DL represents a distance from a rear end of the current image being printed by step S12, from a cutting mark printed immediately behind the current image or from a rear end of a regulating image like the one formed for a preliminary ejection, to the tail end of the sheet roll. At a time when the tail end is detected, the remaining sheet length DL is a length along the sheet conveyance path from the tail end sensor 21 to the rear end of the regulating image attached behind the current image being printed. At the same time step S12 acquires the length of the next image, IL.

The next step S13 compares the remaining sheet length DL updated by step S4 with a threshold TL. At this time, the threshold TL is a sum of the next image length IL acquired by step S12, a minimum sheet length α required for sheet conveyance, a length of the regulating image to be printed behind the next image and a safety margin allowing for a positional error of the tail end sensor 21. The minimum sheet length α is a minimum required sheet length for assuring a smooth sheet conveyance in the printing apparatus and is determined by the construction of the printing apparatus. In this embodiment, the minimum sheet length α is required to be greater than the longest distance between any adjoining two of the many roller pairs.

If step S13 decides that DL>TL=IL+α+regulating image length+safety margin, the controller 16 moves to step S14 and sets a flag indicating that the next image to be printed before exiting the determining processing flow chart. The flag set by step S14 is used at step S6.

In a step S12 of the determining processing flow chart that is executed after the tail end of the continuous sheet is detected and the processing has returned from step S6 to step S1, the remaining sheet length is updated by subtracting from the previously acquired remaining sheet length the length of image currently being printed and the length of the regulating image to be printed behind the current image. This is repeated until the remaining sheet length DL becomes DL≥TL in step S13.

If step S13 decides that the remaining sheet length DL is not DL>TL, step S15 sets a flag indicating that the next image should not be printed. The flag set by step S15 is used for the determining processing at step S6. Then the printing of the current image by the printing unit 4 is stopped and the unprinted sheet is transferred to the cutting unit 6.

In the next step S16 a check is made as to whether the length of sheet being conveyed, DL, is DL>β. β is a longest length of the sheet that can be discharged to the discharge tray 13. If it is found DL>β, the processing moves to step S17 where the continuous sheet being conveyed is cut into a plurality of sheets. At this time, the sheet is cut at such positions and into such a number of sheets that any cut sheet is longer than α but shorter than β. Then, these cut sheets are carried successively through the information recording unit 7, the drying unit 8, the path switching unit 9, the discharging/conveying unit 11 and the sorting unit 12 onto the discharge trays 13 (step S18). At this time, any of these cut sheets is equal to or greater than the minimum sheet length α, they can be conveyed smoothly and discharged onto the discharge trays 13 where they are stacked one upon the other.

If step S16 finds that DL≤β, the processing jumps to step S18 where the non-printed sheet being conveyed is discharged as is onto a discharge tray 13, which is separate from those trays in which the printed sheets are discharged by step S4. With these steps complete, this processing is exited.

The flow chart of FIG. 4 has been described to make a check at step S5 to see if there still is an image to be printed only after a cut sheet printed with an image has been discharged by step S4. It is noted, however, that since the printing unit 4 prints a plurality of images continuously on a sheet being conveyed, the next image actually has already begun to be printed before the current image is cut by the cutting unit 6. That is, the controller 16 controls the printing, cutting and discharging operations on a plurality of image data at the same time by shifting their execution timings from each other. In the flow chart of FIG. 4, it should be noted that the steps that the controller 16 performs on the data of a single image have been explained in the order of execution for the sake of simplicity and that they do not represent a chronological order of operations by the individual units.

The image length acquisition and the management of the remaining sheet length at step S1 and the cut position control at step S11, all described to be executed by the controller 16, may be decided and performed by the external device 17 while communicating with the controller 16.

Figure 5A:
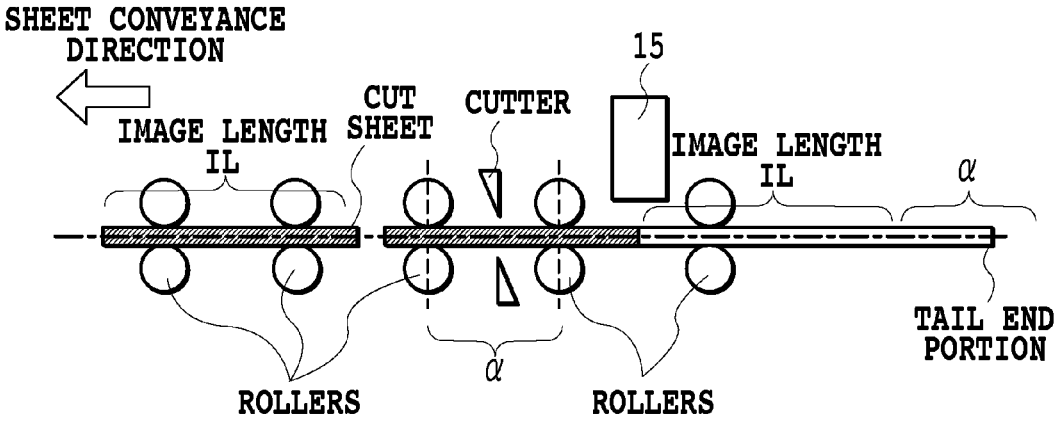
FIGS. 5A-5C are schematic views showing how the tail end processing of this invention works.
Figure 5B:
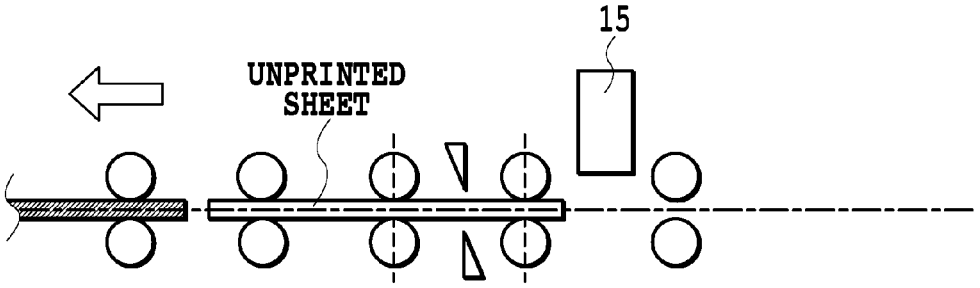
Figure 5C:
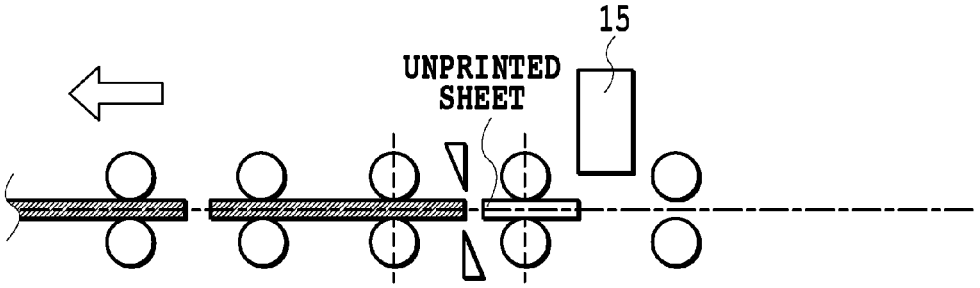

FIGS. 5A-5C are schematic views showing the effectiveness or usefulness of the tail end processing described above in this embodiment. These figures will be explained by referring to the flow chart of FIG. 4.

FIG. 5A shows an operation stage where, with the previous image already printed by the print head 15, a check is being made at step S13 to see if the next image can be printed or not. It is seen in the figure that the sum of next image length IL+α+the regulating image length+safety margin is greater than the remaining sheet length DL at this stage, i.e., DL≤TL. So, the processing moves to step S15 and does not print the next image. It is also seen that in this example state the condition DL>β is not met, so the unprinted remaining sheet is conveyed and discharged without being cut by the cutting unit.

FIG. 5B shows how the remaining sheet of FIG. 5A is further conveyed. With the previous image-printed portion cut from the continuous sheet, the non-printed remaining sheet ranging from the front cut end to the tail end is stably carried successively by a number of roller pairs as it is supported between these paired rollers.

FIG. 5C shows how the last part of the continuous sheet is conveyed when a process of comparing the remaining sheet length DL with the next image length IL to determine whether the next image can be printed, as is done in step S5, is not provided. Printing the next image without taking the remaining sheet length DL into consideration, even if the entire image is able to be printed, can result in the non-printed last part of the sheet being shorter than the minimum required sheet length α. In that case, the non-printed sheet cannot be supported by two or more roller pairs at the same time and is therefore difficult to stably convey and discharge.

FIGS. 6A-6E are schematic views showing another effectiveness or usefulness of the tail end processing described above in this embodiment.

Figure 6A:
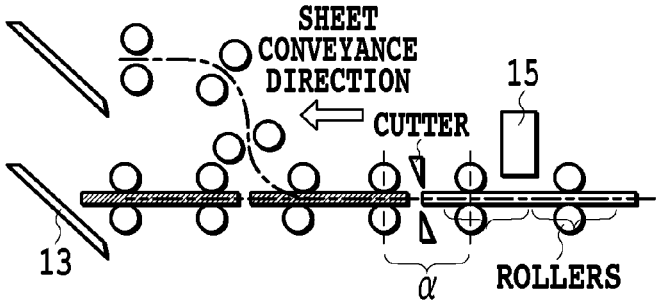
FIGS. 6A-6E are schematic views showing how the tail end processing of this invention works.

FIG. 6A shows an operation stage where step S13 has decided that the next image cannot be printed and where a check is being made at step S16 as to whether or not the non-printed sheet should be cut. This example represents a case in which the non-printed sheet length, or the remaining sheet length DL, is larger than β but smaller than 3α. That is, at step S16, DL>β.

Figure 6B:
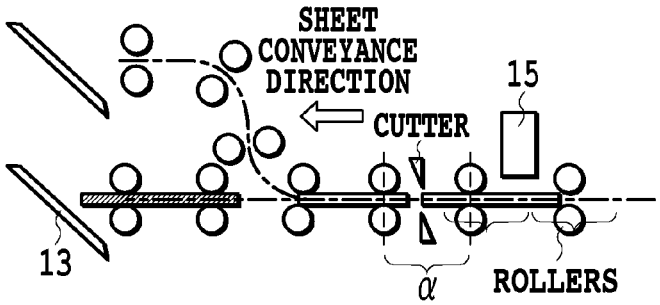

FIG. 6B shows how the non-printed sheet is cut by the cutting unit at step S17. In this example, the cutting is made so that the first of the cut sheets is α in length. That is, the last part of the continuous sheet is cut into two sheets, one equal in length to α and one larger than α but smaller than β.

Figure 6C:
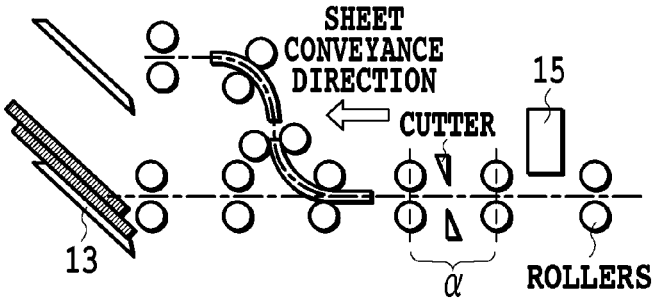

FIG. 6C shows how the two sheets after being cut apart are conveyed. Both of the sheets are longer than the minimum required sheet length and therefore can be stably conveyed successively by a number of roller pairs as they are supported between these paired rollers.

Figure 6D:
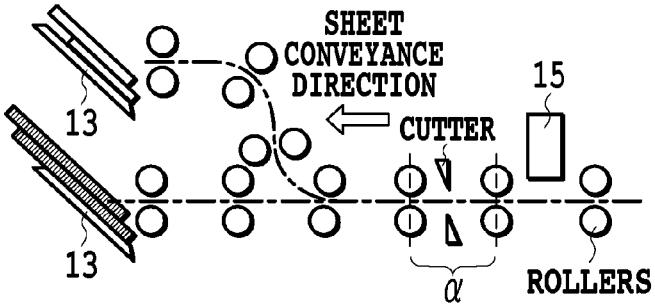

FIG. 6D shows how the two sheets are discharged onto trays. The sheet that was printed with an image and discharged first is thrown onto a lower tray while the non-printed sheet that was discharged following the first sheet is thrown onto an upper tray. In this embodiment, since the non-printed sheet which is longer than β is cut at step S17, the sheet longer than a but shorter than β is placed without hanging out of the upper tray.

Figure 6E:
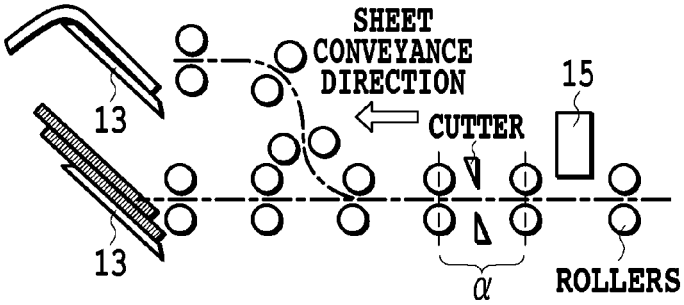

FIG. 6E shows how the sheets are discharged onto trays when a decision is not made on whether or not to cut the sheet according to the length of the non-printed sheet, as it is by step S16 of this embodiment. Discharging the non-printed sheet as is, without taking its length into consideration, can result in the non-printed sheet longer than β hanging out of the tray as shown.

As described above in this embodiment, the provision of a process for comparing the remaining sheet length DL with the next image length IL to decide whether or not the next image can be printed, as is done in step S13, enables a printed sheet with no unintended break of image and an unprinted sheet to be stably conveyed and discharged. Further, the provision of a process for determining whether the non-printed sheet to be cut depending on its length, as in step S16, makes discharged non-printed sheets almost equal in size.

Although, in step S13 of the flow chart of the above embodiment, the threshold TL has been defined as IL+α+regulating image length+safety margin, if the remaining sheet length DL can be calculated by correcting the positional error of the tail end sensor 21, the safety margin may be omitted. Further, if the regulating image can be omitted, or if the regulating image can be printed within the remaining area α in length, the threshold may be set to TL=IL+α. Also, if the tail end portion that goes unprinted can be discharged as a piece of trash out of the conveyance path by the cutting unit 6, the threshold may be set to TL=IL+regulating image length.

Figure 7A:
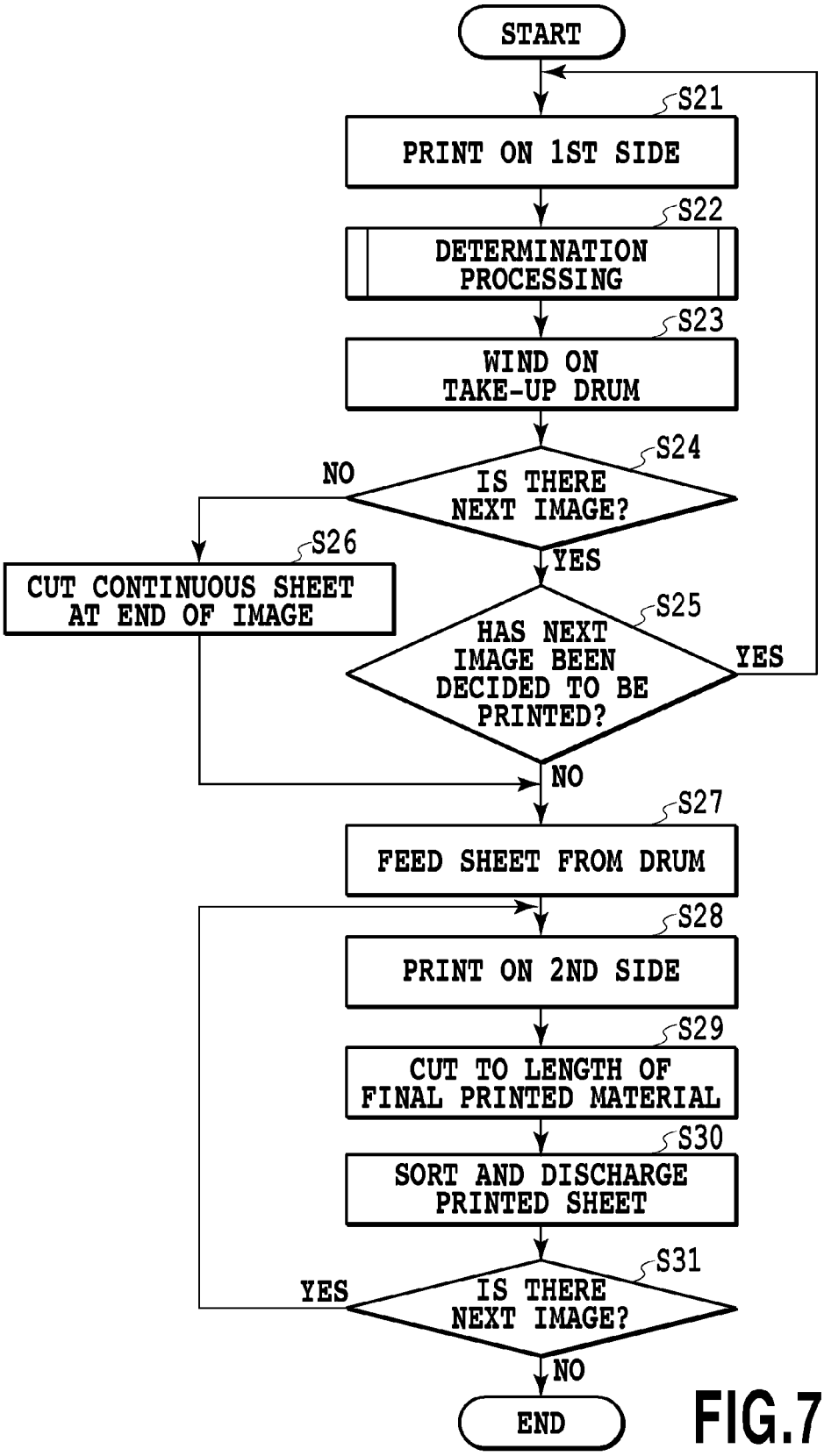
FIGS. 7A and 7B are flow charts showing a sequence of steps during the both-side print mode.
Figure 7B:
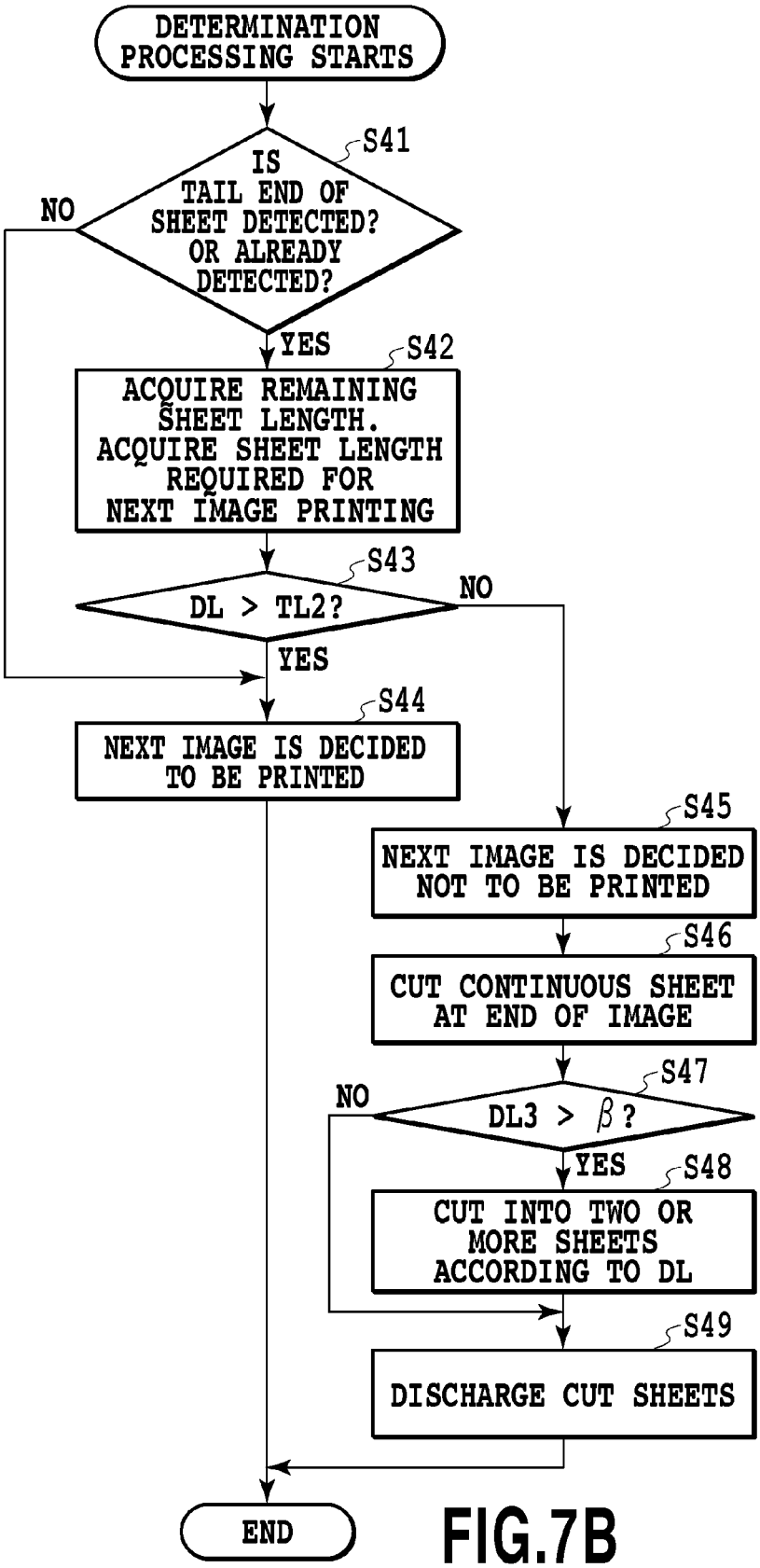

FIGS. 7A and 7B are flow charts showing a two-side print sequence that the controller 16 of this embodiment performs. As explained with reference to FIG. 3, the two-side printing operation involves first forming a plurality of images on the surface of the continuous sheet without cutting it for every image, then cutting the continuous sheet at the rear end of the multiple images to obtain a printed long cut sheet, and printing images on the back of the long cut sheet. That is, in the two-side print sequence, the tail end processing is only required during the first side printing operation that performs the first cutting operation on the sheet drawn out from the roll.

When a print command to start the two-side print sequence is received, the controller 16 at step S21 in FIG. 7A initiates an image printing operation on the first side (front side). At step S22 the controller 16 performs a determining processing while at the same time continuing the printing operation. The determining processing will be detailed later. At step S23, a printed portion of the continuous sheet is wound up on the take-up drum of the sheet winding unit 10 by rotating the drum counterclockwise.

If it is decided at step S24 that there is no image to be printed next on the first side (front side), the controller 16 at step S26 cuts the continuous sheet at the rear end of the last image printed on the first side. It should be noted that since a regulating image needs to be formed before printing the first image on the second side (back side), the actual cut position, strictly speaking, lies upstream of the rear end of the last image by the length of the regulating image to be printed on the second side. Then the controller 16 proceeds to step S27.

If step S24 decides that there is a next image to be printed, the processing moves to step S25 where a check is made to see if step S22 has decided that the next image can be printed. If so, the processing returns to step S21 to print the next image.

If step S22 is found to have decided not to print the next image, the continuous sheet is already cut at the rear end of the current image, as the determining processing flow chart indicates. So, the controller 16 moves to step S27.

At step S27 the long cut sheet, that was wound on the take-up drum after its first side has been printed completely with multiple images, is fed to the printing unit which at step S28 prints images on the second side. After being printed on the second side, the long cut sheet is further cut for every image to the length of a finished print material at step S29. These printed cut sheets are sorted by step S30 and discharged onto the trays 13.

A detailed flow chart of the determining processing executed by step S22 is shown by FIG. 7B. When the determining processing is initiated, a check is made at step S41 to see if, during the sheet conveyance operation, the tail end of the continuous sheet has been detected by the tail end sensor 21. If the tail end is or has already been detected, the processing moves to step S42. If not, it jumps to step S44.

At step S42 the remaining sheet length DL is updated. The definition of the remaining sheet length is the same as in the one-side printing operation. Step S43 compares the remaining sheet length DL updated by step S42 with a threshold TL2 for the two-side printing operation.

The threshold TL2 for the two-side printing operation is determined when the next image is printed on the first side of the continuous sheet, by also considering the length of associated images to be printed on the back (second side) of the sheet. Prior to printing images on the second side, a regulating image for a preliminary ejection and the like is also printed on the second side. So, the second side printing area needs to be longer than the first side printing area by the corresponding amount. The required sheet length for the second side printing is given by IL2 (length of first image to be printed on the second side)+α+length of the regulating image on the second side+safety margin. So, the threshold TL2 for the two-side printing operation is IL+α+regulating image length+safety margin or IL2 (first image length on the second side)+α+regulating image length on the second side+safety margin, whichever is greater.

If at step S43 it is decided that DL>TL2, the controller 16 moves to step S44 where it sets a flag indicating that the next image can be printed, before exiting the determining processing.

If step S43 decides that DL is not larger than TL2, the controller 16 at step S45 sets a flag indicating that the next image is not printed.

Next at step S46 the continuous sheet is cut at the rear end of a series of multiple printed images. The sheet cut position corresponds to a front end of a regulating image to be printed first on the second side. This cutting operation separates the remaining sheet DL2 from a long cut sheet. At this point, the remaining sheet length DL2 is DL—length of regulating image on second side.

At step S47 a check is made as to whether the remaining sheet length DL2 satisfies the condition DL2>β. If DL2≤β, the processing jumps to step S49. If DL2>β, the processing moves to step S48 where it cuts the remaining sheet into a plurality of sheets. At this time, the remaining sheet is cut at such positions and into such a number of sheets that any cut sheet is longer than a but shorter than β. Then at step S49 the controller 16 controls the path switching unit 9 to convey the cut sheets to the sorting unit 12, which at step S30 discharges them onto the trays 13. Since at this time the sheets are all longer than the minimum required length α, they are smoothly conveyed and stacked one upon the other on the intended trays 13. The determining processing is now complete.

As in the one-side print sequence, the two-side print sequence, too, can stably convey and discharge printed sheets and unprinted sheets without causing unintended break of image to any of the printed sheets and can also make the discharged unprinted sheets almost equal in size.

Since in this invention a check is made, for each page, as to whether the image printing is allowed or not by comparing the remaining sheet length with the next image length, an image can be prevented from being broken or interrupted in one page as it may be if the tail end is not properly dealt with. At the same time the printed sheets and non-printed sheets can be conveyed and discharged stably. Further, since a decision is made on whether or not to cut a non-printed sheet remaining in the printing apparatus into shorter ones depending on its length, the remaining non-printed sheet can be made long enough for them to be able to be conveyed in the printing apparatus and short enough to be accommodated onto the discharge trays, with the result that the sheets of the similar size can be stacked on the discharge trays.

Although the minimum sheet length α has been described to be "greater than the largest distance between any two adjoining roller pairs among a plurality of roller pairs in the printing apparatus," this invention does not necessarily require such a limitation. A conveyance belt may be provided in the printing apparatus in addition to the roller pairs. In that case, the minimum sheet length α does not depend only on the distance between the two adjoining roller pairs. The sheet conveyance performance in the printing apparatus is also affected by the geometry of the conveyance path. With these factors taken into consideration, the minimum sheet length in this invention needs only to be long enough to ensure a smooth transport of sheets.

The tail end sensor has been described to be installed on the conveyance path of the continuous sheet because this construction can manage the remaining sheet length highly precisely, minimizing the wasted roll paper, when compared with a system that acquires the remaining sheet length from a diameter of a paper roll as in Japanese Patent Laid-Open No. 2001-171881. It is noted that the invention is not limited to this construction. For example, the passage of a tail end of the paper roll may be known by detecting an abrupt change in a rotation speed of the roll core when the tail end leaves the roll core. This construction also can achieve a highly precise management of the remaining sheet length as in the aforementioned embodiment. This invention, of course, does not exclude a construction, such as proposed by Japanese Patent Laid-Open No. 2001-171881, that acquires the remaining sheet length from the roll diameter. Whichever construction is chosen, the advantages of this invention can be realized as long as a detection means is provided which, when the remaining sheet length of a paper roll is running low, triggers a control sequence of managing the remaining sheet length thereafter.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-231518, filed Oct. 21, 2011, which is hereby incorporated by reference herein in its entirety.

What is claimed is:

1. A printing apparatus comprising:

a conveyance unit configured to convey a continuous sheet in a predetermined conveyance direction;

a printing unit configured to print an image on the continuous sheet;

a specifying unit configured to specify a first length representing a length from a rear end of first page being currently printed on the continuous sheet to the tail end of the continuous sheet in the predetermined conveyance direction by using a sensor, as a remaining sheet length;

a determination unit configured to determine whether a second page following the first page is printed based on the first length and a second length representing a length of the second page in the predetermined conveying direction, wherein if the first length is smaller than the second length, it is determined that the second page is not printed, and wherein if the first length is larger than the second length it is determined that the second page is printed;

a cutter configured to cut the continuous sheet that has been subjected to printing of an image by the printing unit for every page; and an accommodation tray to accommodate unprinted sheets, that is different from a tray to accommodate printed sheets, wherein the cutter cuts an unprinted sheet into sheets of lengths long enough for them to be conveyed but short enough to be accommodated on the accommodation tray.

2. A printing apparatus according to claim 1, further comprising:

a tail end detection unit located upstream of the printing unit and configured to detect a passage of the tail end of the continuous sheet, wherein the remaining sheet length management unit calculates the remaining sheet length by using a remaining sheet length when the tail end detection unit has detected the tail end of the continuous sheet and a distance that the continuous sheet has been conveyed thereafter.

3. A printing apparatus according to claim 1, wherein in a case where, during a both-side printing, a sheet length required for printing a first page on a back side is larger than the sheet length required for printing a next page on a surface side, the remaining sheet length is compared to the sheet length required for printing the first page on the back side.

4. A printing apparatus according to claim 1, wherein the printing operation by the printing unit and the determining operation by the determination unit are performed concurrently.

5. A printing method comprising:

a conveyance step for conveying a continuous sheet in a predetermined conveyance direction;

a printing step for printing an image on the continuous sheet;

a specifying step for specifying a first length representing a length from a rear end of first page being currently printed on the continuous sheet to the tail end of the continuous sheet in the predetermined conveyance direction by using a sensor, as a remaining sheet length;

a determination step for determining whether a second page following the first page is printed based on the first length and a second length representing a length of the second page in the predetermined conveying direction, wherein if the first length is smaller than the second length, it is determined that the second page is not printed, and wherein if the first length is larger than the second length, it is determined that the second page is printed;

a cutting step for cutting the continuous sheet that has been subjected to printing of an image by the printing unit for every page; and an accommodation step for accommodating unprinted sheets on an accommodation tray that is different from a tray to accommodate printed sheets, wherein the cutter cuts an unprinted sheet into sheets of lengths long enough for them to be conveyed but short enough to be accommodated on the accommodation tray.

* * * * *